US005737057A

United States Patent [19]

Kojima et al.

[11] Patent Number: 5,737,057

[45] Date of Patent: Apr. 7, 1998

[54] OCULAR LENS FABRICATION METHOD AND OCULAR LENS FABRICATION APPARATUS

[75] Inventors: Tosio Kojima; Kazumi Aikyo; Chikai Kosaka, all of Gifu, Japan

[73] Assignee: Menicon Co., Ltd., Nagoya, Japan

[21] Appl. No.: 617,935

[22] Filed: Mar. 15, 1996

[30] Foreign Application Priority Data

Mar. 16, 1995 [JP] Japan ..... 7-057048

[51] Int. Cl.[6] ..... G02C 7/04; B24B 1/00; B24B 41/06

[52] U.S. Cl. ..... 351/177; 451/42; 451/390

[58] Field of Search ..... 451/42, 43, 390; 351/177

[56] References Cited

U.S. PATENT DOCUMENTS 5,007,975 4/1991 Yamamoto et al. ..... 156/154

FOREIGN PATENT DOCUMENTS

| | | |
|---|---|---|
| 0035317 | 9/1981 | European Pat. Off. . |
| A10035317 | 9/1981 | European Pat. Off. . |
| 9612590 | 5/1996 | WIPO . |
| WO96/12590 | 5/1996 | WIPO . |

*Primary Examiner*—Scott J. Sugarman

*Attorney, Agent, or Firm*—Sughrue, Mion, Zinn, Macpeak & Seas, PLLC

[57] ABSTRACT

A lens material 66 is caused to overlap upon a curved surface of a support body 90 through an adhesive with the lens material 66 supported by a rotary spindle 18 of a first machining device 14. Then, such lens material 66 is bonded to the support body 90 by aligning the lens material 66 with the support body 90 while rotating the lens material 66 and the support body 90 relative to each other by rotating the rotary spindle 18 with the support body 90 being allowed to move in directions orthogonal to a rotary shaft of the rotary spindle 18.

8 Claims, 8 Drawing Sheets

OCULAR LENS FABRICATION METHOD AND OCULAR LENS FABRICATION APPARATUS

BACKGROUND OF THE INVENTION

1. Field of the Invention

The invention relates to a method and apparatus for fabricating various types of ocular lenses such as soft contact lenses, hard contact lenses, and intraocular implants. The invention is directed particularly to an improvement of an ocular lens fabrication method and apparatus characterized as bonding a predetermined support body to a machined surface of a lens material and causing a machining device to support the thus machined lens material through the support body at the time of machining the other surface of the lens material after one surface of the lens material has been machined.

2. Related Art

Ocular lenses are generally fabricated by sequentially cutting the surface of a blocked lens material on a single surface basis using a cutting tool, a grinding tool, or the like by rotating the lens material attached to a rotary spindle of a machining device about a single axis. When the other surface of the lens is to be cut after one lens surface has been cut in such ocular lens fabrication process, a predetermined support body having a curved surface corresponding to the machined lens surface is employed to not only protect the machined lens surface but also to allow the thin lens material to be supported by the rotary spindle of the machining device. That is, the lens material has the machined surface to be bonded to the curved surface of the support body which corresponds to the machined surface.

By the way, a concave lens surface and a convex lens surface are cut by different machining devices, respectively. The lens material must be re-attached to the rotary spindle of a different machining device to cut the other lens surface after one lens surface has been cut. The operation of bonding the lens material to the support body has been performed at the time of such lens material re-attaching operation in the conventional art.

To bond the lens material to the support body, one must align the lens material with the support body with high accuracy in order to prevent misalignment of the optical axis of the inner surface of the lens with respect to that of the outer surface thereof. That is, it has been a must that the operation of aligning the lens material with the support body and bonding the former to the latter be performed manually on a single lens basis in the conventional art.

However, the manual operation of bonding the lens material to the support body is extremely cumbersome, less operable, and time-consuming. In addition, it is likely that consistent alignment accuracy will not be ensured.

SUMMARY OF THE INVENTION

The invention has been made in view of the aforementioned circumstances. The object of the invention is therefore to provide an improved method and apparatus for fabricating ocular lenses, which allows the operation of bonding the lens material to the support body to be performed with high operability and consistent alignment accuracy.

To achieve the above object, the invention is applied to an ocular lens fabrication method characterized as follows. In overlapping a machined lens surface of a lens material upon a curved surface of a support body to be attached to a rotary spindle of a second machining device and bonding the machined lens surface of the lens material to the curved surface of the support body using a predetermined adhesive after one lens surface of the lens material has been machined with the lens material being supported by a rotary spindle of a first machining device, the second machining device cutting other lens surface of the lens material, the curved surface of the support body is overlapped upon the machined lens surface of the lens material through the predetermined adhesive with the lens material being supported by the rotary spindle of the first machining device; and the lens material is aligned with the support body by rotating the lens material and the support body relative to each other while rotating the rotary spindle of the first machining device with the support body being allowed to move in directions orthogonal to a rotary shaft of the rotary spindle of the first machining device.

In a first preferred mode of embodiment of the invention, the lens material is temporarily bonded to the support body with the lens material being supported by the rotary spindle of the first machining device; and the lens material is regularly bonded to the support body after having been removed from the rotary spindle of the first machining device.

In a second preferred mode of embodiment of the invention, an ultraviolet curing adhesive is used as the adhesive; and ultraviolet rays are irradiated onto the lens material and the support body after the lens material has been aligned with the support body.

The invention is also applied to an ocular lens fabrication apparatus including: (a) a first machining device for cutting one lens surface of a lens material with the lens material being supported by a rotary spindle; (b) a support body supply device for not only guiding a support body toward the front of the lens material supported by the rotary spindle of the first machining device, the support body being attached to a rotary spindle of a second machining device for cutting the other lens surface of the lens material, but also supporting the support body with the support body being allowed to move in directions orthogonal to a rotary shaft of the rotary spindle of the first machining device by overlapping the one machined lens surface of the lens material upon a curved surface of the support body; (c) an adhesive supply device for supplying a ultraviolet curing adhesive between the one surface of the lens material and the curved surface of the support body, the one lens surface and the curved surface having been overlapped one upon the other; and (d) a first ultraviolet irradiation device for guiding and irradiating ultraviolet rays between the one lens surface of the lens material and the curved surface of the support body having been overlapped one upon the other through the ultraviolet curing adhesive.

In a first preferred mode of embodiment of the invention, the ultraviolet rays irradiated by the first ultraviolet irradiation device are guided between the one surface of the lens material and the curved surface of the support body having been overlapped one upon the other by transmitting the support body.

In a second preferred mode of embodiment, a second ultraviolet irradiation device is arranged, the second ultraviolet irradiation device guiding and irradiating ultraviolet rays onto a bonded surface of a bonded body along a transfer path of the bonded body toward the second machining device, the bonded body being formed of the lens material and the support body, the bonded body having been removed from the rotary spindle of the first machining device.

In a third preferred mode of embodiment, the rotary spindle of the first machining device is constructed of a horizontally extending rotary center shaft; and the support supply device has a support board being turned to a first support position for supporting the curved surface of the support body so as to face vertically upward and to a second support position for supporting the curved surface of the support body so as to face horizontally, the curved surface of the support body being guided to a ultraviolet curing adhesive dropping position by the adhesive supply device at the first support position of the support board, the support body being guided to such a position as to allow the curved surface of the support body to confront the one surface of the lens material supported by the rotary spindle of the first machining device at the second support position.

According to the method of the invention, the lens material is rotated about the optical axis (cutting center shaft) based on the rotation of the rotary spindle of the machining device. Therefore, the cut surface of the lens material is rotated relative to the curved surface of the support body that is overlapped upon the cut surface to provide the automatic self-aligning function. As a result of this operation, the lens material can be aligned with the support body.

Hence, according to the method of the invention, the operation of aligning the lens material with the support body and the operation of bonding the former to the latter that have been performed manually in the conventional art can be performed automatically with the lens material being supported by the rotary spindle of the machining device. Therefore, not only operability can be improved significantly, but also aligning accuracy can be stabilized.

Further, the first preferred mode of embodiment of the method of the invention can save time in which the lens material is left supported by the rotary spindle of the first machining device for temporarily bonding the lens material to the support body. Therefore, not only the lens material can be machined by the first machining device, but also the operating cycle for the bonding of the lens material to the support body can be improved. It may be noted that the regular bonding of the lens material to the support body is desirably performed along the forward path toward the second machining device or at a stock area before the lens material is attached to the second machining device. As a result, impairment in the lens fabricating cycle due to the regular bonding operation can be prevented.

Still further, the second preferred mode of embodiment of the method of the invention allows the bonding of the lens material to the support body to be performed quickly after the alignment. The second preferred mode of embodiment provides in particular the advantage of facilitating the bonding operation to be performed in two steps, temporary bonding and regular bonding. While a known ultraviolet curing adhesive may be used, an adhesive containing photocuring silicone oil and photoactivating agent and further containing photosensitizing agent, if necessary, is suitably used, as disclosed, e.g., in Unexamined Japanese Patent Publication No. Hei. 1-101319. The use of such an adhesive not only prevents negative effects from being exerted upon the lens material, but also facilitates the peeling of the lens material from the support body after the lens has been machined.

Further, the ocular lens fabrication apparatus of the invention not only allows the method of the invention to be applied thereto advantageously, but also allows the operation of aligning the lens material with the support body and of bonding the former to the latter to be performed automatically with the lens material supported by the rotary spindle of the machining device. Therefore, ocular lens fabricating efficiency, and operating efficiency in both aligning the lens material with the support body and bonding the former to the latter, in particular, can be improved significantly. In addition, accuracy in aligning the lens material with the support body can be improved and stabilized.

Still further, the first preferred mode of embodiment of the apparatus of the invention allows ultraviolet rays to be guided advantageously and irradiated substantially consistently onto the bonded surface of the lens material and the support body. Therefore, consistent bond strength can be obtained efficiently.

Further, the second preferred mode of embodiment of the apparatus of the invention not only allows regular bonding of the lens material to the support body to be performed after the lens material has been removed from the first machining device, but also contributes to saving time in which the lens material is left attached to the first machining device for bonding the lens material to the support body. Therefore, the operating cycle including the machining, etc. of the lens material by the first machining device can be improved. That is, under the condition that the lens material is attached to the first machining device, what is required is merely temporary bonding in which such a bond strength as to prevent misalignment of the lens material with respect to the support body during the forwarding of the bonded body to the second machining device is ensured. That is, such a bond strength as to bear the cutting operation to be performed by the second machining device is required to be ensured by ultraviolet irradiation along the transfer path. Hence, time for the temporary bonding operation that is performed with the lens material attached to the first machining device can be saved.

Further, the third preferred mode of embodiment of the apparatus of the invention not only allows the adhesive to be supplied to the bonded surface with ease by dropping the ultraviolet curing adhesive onto the curved surface of the support body at the first support position, but also allows the support body to be guided advantageously to such a position as to allow the curved surface of the support body to confront the lens surface of the lens material supported by the rotary spindle of the first machining device by the turning of the second support position.

DESCRIPTION OF THE PREFERRED EMBODIMENTS

To illustrate the invention more specifically, an embodiment of the invention will be described in detail with reference to the drawings.

Figure 1:
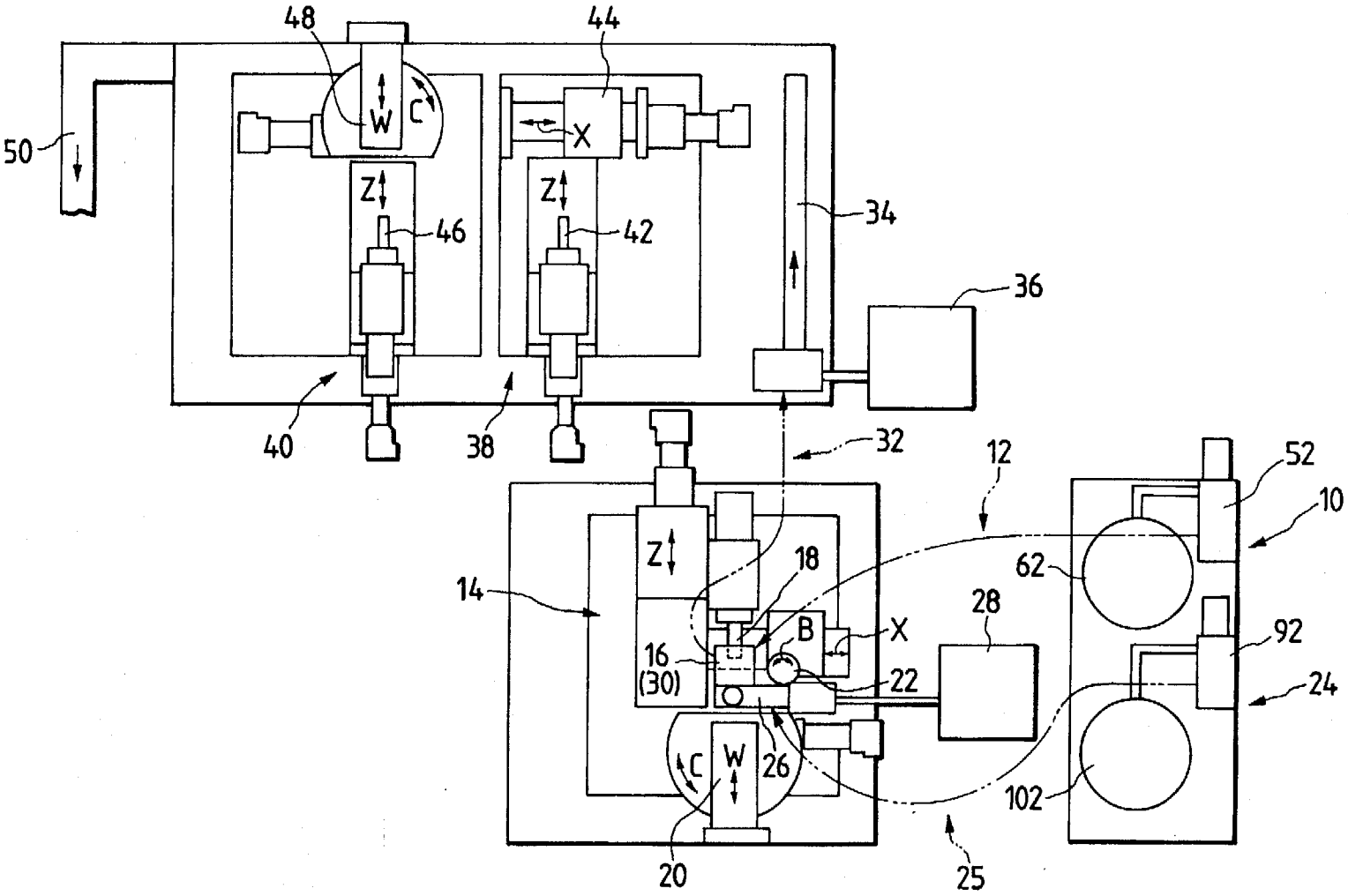
FIG. 1 is a schematic plan view showing the entire part of a contact lens cutting apparatus including a contact lens manufacturing apparatus, which is an embodiment of the invention.
Figure 2:
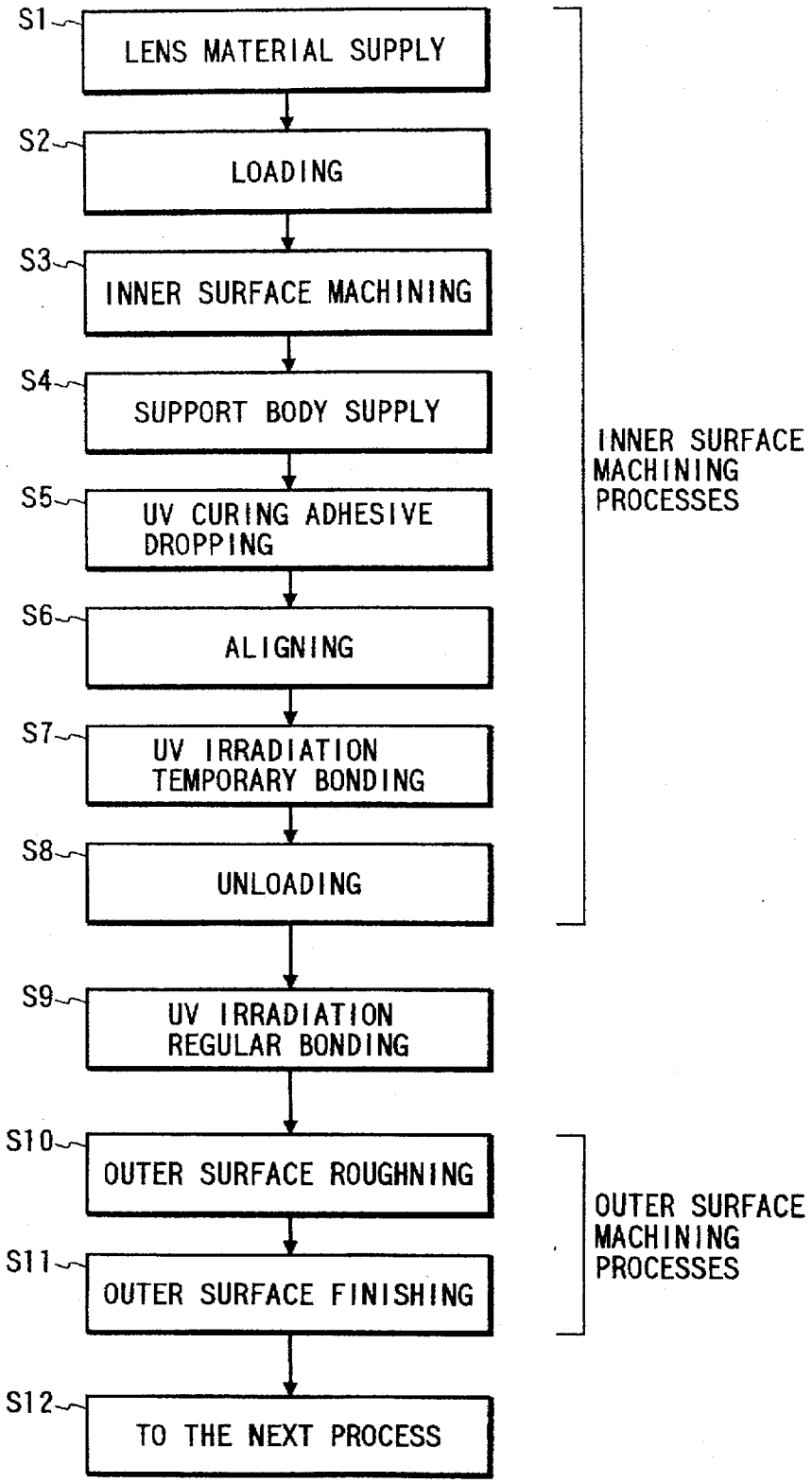
FIG. 2 is a schematic flow diagram of contact lens cutting processes performed by the contact lens cutting apparatus shown in FIG. 1.

FIG. 1 is a schematic plan view showing the entire part of a contact lens cutting apparatus. FIG. 2 is a schematic flow diagram of contact lens cutting processes performed by this cutting apparatus. The contact lens cutting processes will be outlined with reference to FIGS. 1 and 2. First, in a lens material supply process S1 a lens material is fed out by a first parts feeder 10 and supplied to a loader 16 of an inner surface machining device 14 serving as a first machining device via a first air chute hose 12. Then, in a loading process S2 the lens material is chucked by the loader 16 while guided by a chuck of a rotary spindle 18 of the inner surface machining device 14. In an inner surface machining process S3 the lens material is machined by the inner surface machining device 14 so that the inner surface (concave surface) of a lens is cut.

The operation of cutting the inner surface of the lens is performed using the inner surface machining device 14 in the following way. As shown, e.g., in FIG. 1, the inner surface machining device 14 has the rotary spindle 18, a first cutter bench 20, and a second cutter bench 22. The rotary spindle 18 is driven to reciprocate along the horizontally extending rotary center shaft (in directions of Z axis). The first cutter bench 20 is driven to reciprocate along the horizontally extending W axis and is driven to turn about a vertically extending single axis in directions of C, the vertically extending single axis being orthogonal to the W axis. The second cutter bench 22 is driven to reciprocate along a horizontally extending X axis orthogonal to the Z axis and is driven to turn about a vertically extending B axis orthogonal to the X axis. The first cutter bench 20 and the second cutter bench 22 are arranged at the chuck section so as to confront each other. Using the thus constructed inner surface machining device 14, the rotary spindle 18 is first caused to near the first cutter bench 20 in the Z axis direction, and the first cutter bench 20 is then turned about the W axis as well as about the single axis in the C directions, so that the inner surface of the lens is cut while setting a proper radius of curvature. Upon end of the inner surface cutting operation, the rotary spindle 18 is moved away from the first cutter bench 20, and then the second cutter bench 22 is caused to near the rotary spindle 18 in the direction orthogonal to the rotary spindle 18 to thereby turn the second cutter bench 22 about the X axis as well as about the B axis. Under this condition, DIA (the projected maximum outer diameter) machining operation and edging operation are performed. The operation of cutting the inner surface of the lens is performed in this way.

After the operation of cutting the inner surface of the lens has been ended, a support body, which is to be bonded to the lens material for protecting the lens surface as well as for causing an outer surface machining device to support the lens material, is fed out of a second parts feeder 24, and is supplied to a support body supply device 26 via a second air chute hose 25 in a support body supply process S4. The support body supply device 26 is arranged in front of the rotary spindle 18 of the inner surface machining device 14. In a UV (ultraviolet) curing adhesive dropping process S5 a ultraviolet curing adhesive is dropped onto a bonding surface of the support body. After the process S5, in an aligning process S6 the bonding surface of the support body is caused to overlap upon the machined surface (inner surface) of the lens material, and the support body and the lens material are aligned with each other while being caused to rotate relative to each other by low speed rotation of the rotary spindle 18 of the inner surface machining device 14 to which the lens material has been chucked. Then, in a UV irradiation temporary bonding process S7, ultraviolet rays are irradiated onto the surface upon which the support body and the lens material, aligned with each other, overlap one upon the other by a first UV irradiation device 28. The support body and the lens material are temporarily bonded to each other with such a bond strength as not to cause misalignment. Then, in an unloading process S8 the lens material that has been temporarily bonded to the support body is removed from the rotary spindle 18 of the inner surface machining device 14 by an unloader 30, discharged from the inner surface machining device 14 by a third air chute hose 32, and sent to a transfer conveyor 34 to be forwarded to the outer surface machining device serving as a second machining device. Ultraviolet rays are further irradiated onto the bonded surface of the support body and the lens material that have been temporarily bonded to each other by a second UV irradiation device 36 in a UV irradiation regular bonding process S9 after the lens material discharged from the inner surface machining device 14 has been transferred by the third air chute hose 32 and before the lens material is carried on the transfer conveyor 34. As a result of this regular irradiation, the lens material is bonded to the support body with such a bond strength as to bear the external force to be applied thereto during the outer surface machining operation performed by the outer surface machining device.

In this embodiment the outer surface machining device includes an outer surface roughing device 38 and an outer surface finishing device 40. In an outer surface roughing process S10, the outer surface (convex surface) of the lens material is spherically roughened by the outer surface roughing device 38, and then in an outer surface finishing process S11, the thus roughened outer surface of the lens material is finished by the outer surface finishing device 40. The outer surface of the lens is thus cut through these processes. The outer surface roughing device 38 and the outer surface finishing device 40 used may be known devices. For example, as shown in FIG. 1, the outer surface roughing device 38 has a rotary spindle 42 and a cutter bench 44 arranged so as to confront each other at the chuck section of the rotary spindle 42. The rotary spindle 42 is driven to reciprocate along the horizontally extending rotary center shaft (in directions of Z axis). The cutter bench 44 is driven to reciprocate along the horizontally extending X axis orthogonal to the Z axis. This outer surface roughing device 38 spherically roughens the outer surface of the lens material by moving the cutting point so as to interpolate biaxially in the diametrical direction through the movement of the rotary spindle 42 in the Z axis directions and of the cutter bench 44 in the X axis directions. Further, for example, the outer surface finishing device 40 has a rotary spindle 46 and a cutter bench 48 arranged so as to confront each other at the chuck section of the rotary spindle 46. The rotary spindle 46 is driven to reciprocate along the horizontally extending rotary center shaft (in directions of Z axis). The cutter bench 48 is driven to reciprocate along the horizontally extending W axis and is driven to turn about a single vertically extending axis in directions of C, the single vertically extending axis being orthogonal to the W axis. The thus constructed outer surface finishing device 40 cuts the outer surface of the lens material with a proper radius of curvature through the movement of the rotary spindle 46 in the Z axis directions and the turn of the cutter bench 48 about the W axis as well as about the single axis thereof in the C directions.

The lens material whose inner and outer surfaces have been thus machined is taken out of the outer surface finishing device 40 while bonded to the support body and then discharged by a discharge conveyor 50 in a discharge process S12. As a result, the lens material cutting operation is terminated. Further, the discharged lens material is generally subjected to an inspection for checking the radius of curvature of the outer surface and a like inspection while bonded to the support body.

An appropriate forward device is employed for each of the lens material forward operations with the support body bonded to the lens material, the forward operations including one from the transfer conveyor 34 to the outer surface roughing device 38 and one from the outer surface finishing device 40 to the discharge conveyor 50. For example, an automatic forward device including a slide pat, an unloader, and a loader may be employed. The slide pat reciprocates along various transfer paths. The unloader receives the lens material from the transfer conveyor 34 or from the rotary spindle 42 of the outer surface roughing device 38 and the like and hands the lens material over to the slide pat. The loader receives the lens material from the slide pat and chucks the lens material to the rotary spindle 42 of the outer surface roughing device 38 and the like or supplies the lens material to the discharge conveyor 50.

Main parts of the aforementioned contact lens cutting processes will be described with reference to the detailed drawings of the devices.

Figure 3:
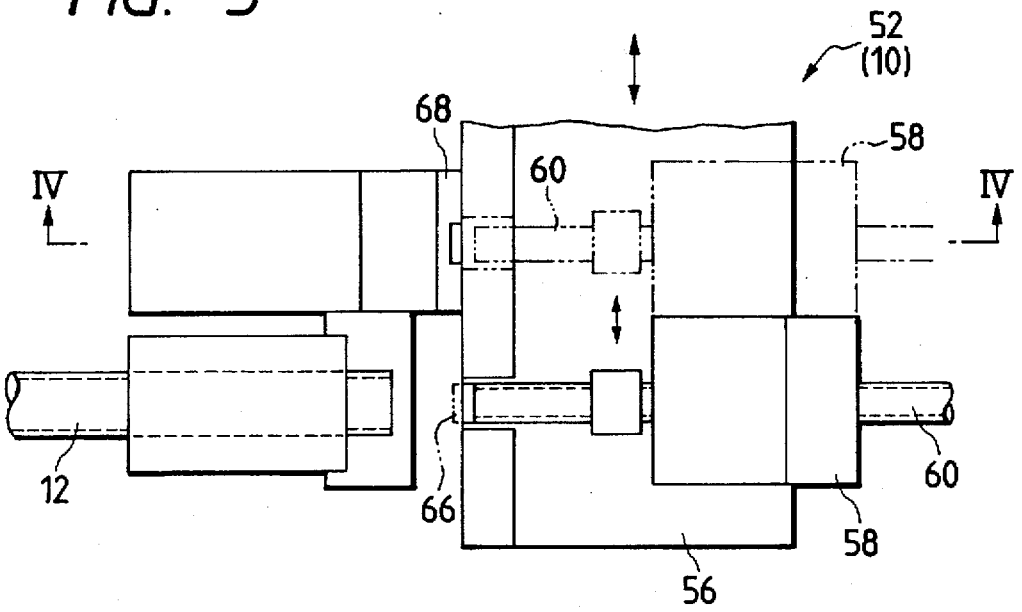
FIG. 3 is a plan view schematically showing a construction of a pneumatic forward section in a first parts feeder constituting the contact lens cutting apparatus shown in FIG. 1.
Figure 4:
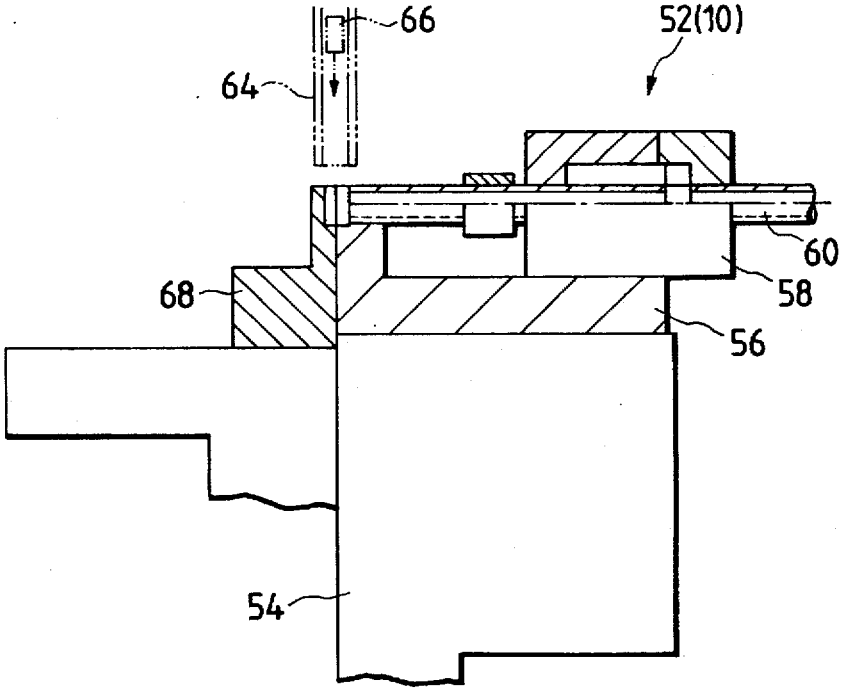
FIG. 4 is a sectional view taken along a line IV—IV of FIG. 3.

First, FIGS. 3 and 4 are a plan view and a sectional view showing a pneumatic forward section 52 in the first parts feeder 10 that supplies the lens material to the loader 16 of the inner surface machining device 14 in the lens material supply process S1. The pneumatic forward section 52 is supported by a table 54 so as to be movable in horizontal directions, and has a movable base 56 that is caused to reciprocate only by a predetermined distance by a not shown drive means. An air cylinder 58 is fixed on the movable base 56. The air cylinder 58 drives an air tube 60 to reciprocate in horizontal directions (in axial directions of the tube) orthogonal to the movable base 56 moving direction. The air tube 60 is connected to a not shown pneumatic source.

In a first moving end of the movable base 56 (the upper moving end shown by the phantom line in FIG. 3), not only a lens material 66 is guided from above by a guide rail 64 toward an opening of the air tube 60 from a lens material accommodating section 62 (see FIG. 1), but also the thus guided lens material 66 is adsorbed to and held by the opening of the air tube 60 so as to be sucked by air pressure. Further, in the front of the opening of the air tube 60, an angled positioning member 68 having a notch for receiving and positioning the lens material 66 is arranged. Still further, the first air chute hose 12 is arranged on the side of the positioning member 68 so as to define the opening position thereof. The opening of the air tube 60 is positioned to confront the opening of the first air chute hose 12 when the movable base 56 is positioned in a second moving end (the moving end on the side shown by the solid line in FIG. 3).

Thus, not only the movable base 56 is caused to move to the second moving end after the lens material 66 has been adsorbed to and held by the opening of the air tube 60 in the first moving end of the movable base 56, but also the air tube 60 is driven to project by the air cylinder 58 to cause the opening of the air tube 60 to face the opening of the first air chute hose 12. Under this condition, compressed air is jetted out via the air tube 60, so that the lens material 66 is sent into the first air chute hose 12 to be forwarded therethrough.

Figure 5:
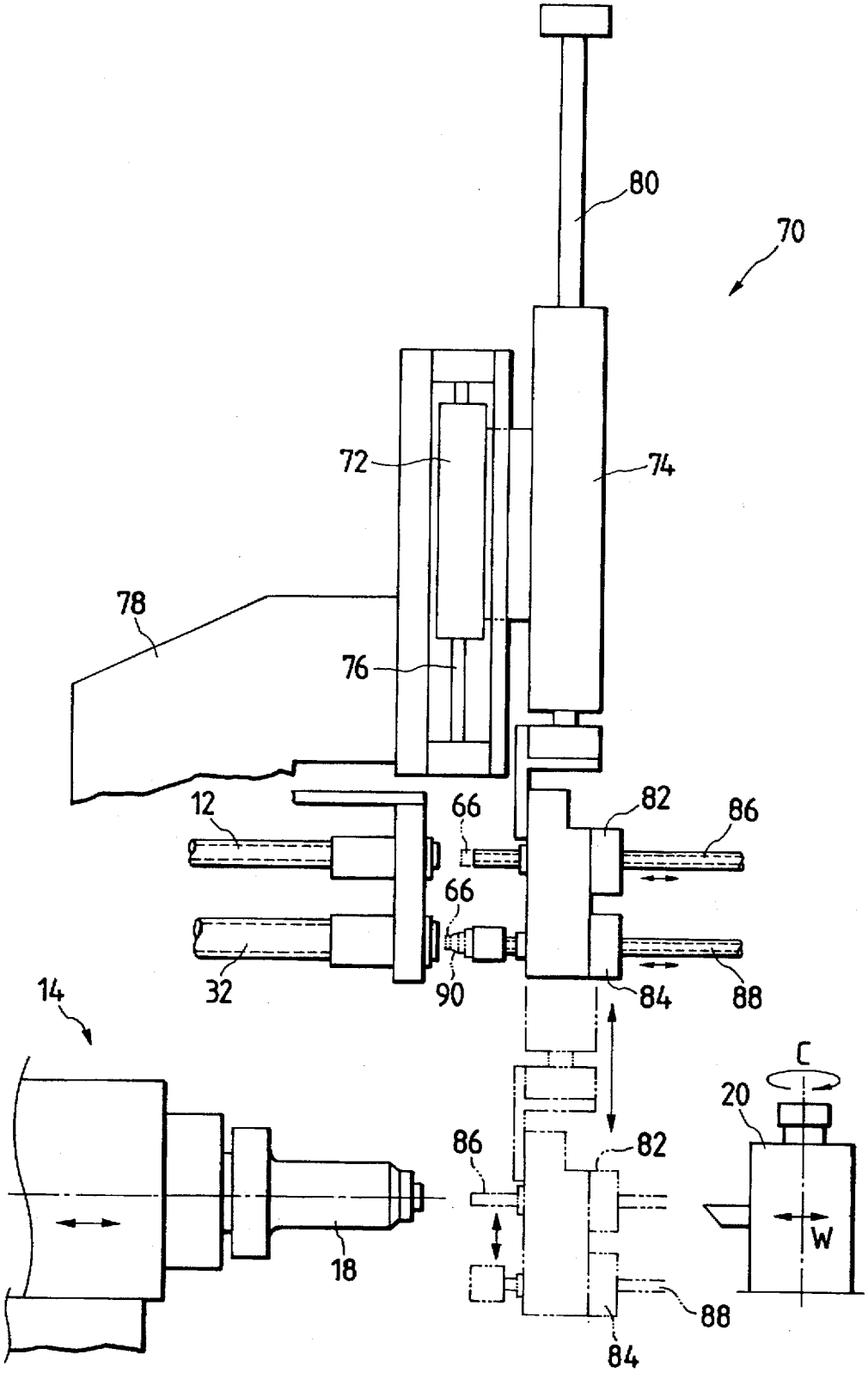
FIG. 5 is a front view schematically showing a construction of a loader/unloader constituting the contact lens cutting apparatus shown in FIG. 1.

Then, FIG. 5 shows the loader (16), which not only receives the lens material 66 forwarded via the first air chute hose 12 by the aforementioned pneumatic forward section 52, but also chucks the lens material 66 to the rotary spindle 18 of the inner surface machining device 14 in the loading process S2. In this embodiment the unloader 30, which removes the lens material 66 with the support body bonded thereto from the rotary spindle 18 of the inner surface machining device 14 and guides the unchucked lens material 66 to the third air chute hose 32 in the unloading process S8 after the cutting operation has been performed by the inner surface machining device 14, is formed integrally with the loader 16. Therefore, the unloader 30 will be described together with the loader 16 as a loader/unloader 70.

The loader/unloader 70 is located above a space between the confronting surface of the rotary spindle 18 of the inner surface machining device 14 and that of the first cutter bench 20 thereof, and has a first drive cylinder 72 and a second drive cylinder 74, each having a vertically extending piston rod. The piston rod 76 of the first drive cylinder 72 is secured to a table 78, and the second drive cylinder 74 is secured to the first drive cylinder 72. When the first drive cylinder 72 is driven to move vertically, the second drive cylinder 74 moves vertically together with the first drive cylinder. Further, a loading air cylinder 82 and an unloading air cylinder 84 are secured to the lower end portion of the piston rod 80 of the second drive cylinder 74. The loading air cylinder 82 and the unloading air cylinder 84 drive a loading air tube 86 and an unloading air tube 88 to reciprocate along the length of the tubes that run in parallel with the rotary spindle 18 of the inner surface machining device 14, the air tubes 86, 88 being connected to not shown pneumatic sources, respectively.

When the loading and unloading air cylinders 82, 84 are positioned in the upper moving end by the first and second drive cylinders 72, 74, not only the opening of the loading air tube 86 is positioned so as to confront the opening of the first air chute hose 12, but also the opening of the unloading air tube 88 is positioned so as to confront the opening of the third air chute hose 32. Further, by moving the second drive cylinder 74 vertically by the first drive cylinder 72 with the piston rod 80 of the second drive cylinder 74 projected downward, either one of the openings of the loading air tube 86 and the unloading air tube 88 is positioned so as to confront the rotary spindle 18 of the inner surface machining device 14.

As a result, the loading air tube 86 not only adsorbs and holds the lens material 66 forwarded via the first air chute hose 12, but also guides the lens material 66 to the chuck section of the rotary spindle 18 of the inner surface machining device 14 to be chucked. On the other hand, the unloading air tube 88 not only adsorbs and holds the lens material 66 with the support body bonded thereto by the inner surface machining operation performed by the inner surface machining device 14 by removing the lens material 66 from the chuck section of the rotary spindle 18 of the inner surface machining device 14, but also guides the lens material 66 with the support body bonded thereto to the opening of the third air chute hose 32 so that the lens material 66 can be transported through the third air chute hose 32 by air pressure.

Figure 6:
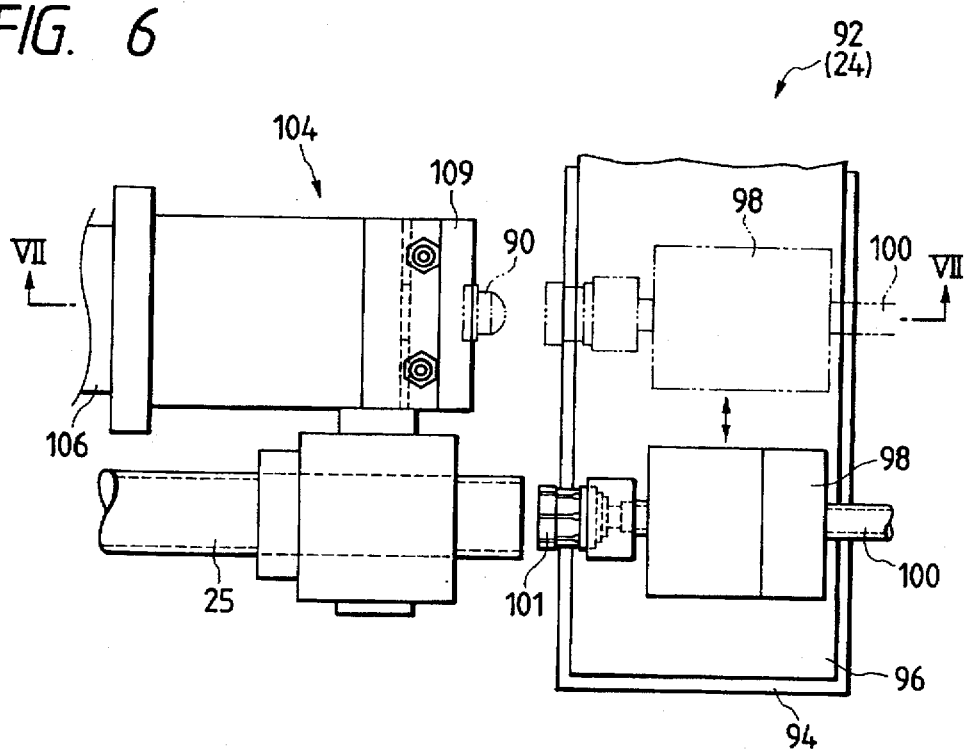
FIG. 6 is a plan view schematically showing a construction of a pneumatic forward section in a second parts feeder constituting the contact lens cutting apparatus shown in FIG. 1.
Figure 7:
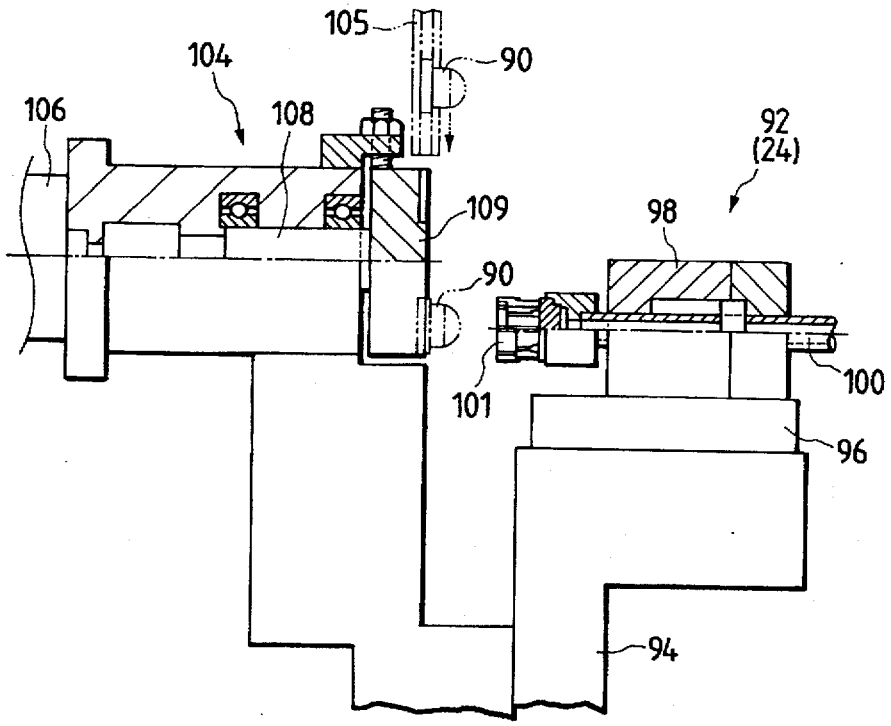
FIG. 7 is a sectional view taken along a line VII—VII of FIG. 6.

Further, FIGS. 6 and 7 are a plan view and a sectional view showing a pneumatic forward section 92 in the second parts feeder 24 that supplies a support body 90 to be bonded to the machined inner surface of the lens material 66 to the loader/unloader 70 serving as the unloader 30 of the inner surface machining device 14 in the support body supply process S4. The pneumatic forward section 92 is supported by a table 94 so as to be movable in horizontal directions and has a movable base 96 that is caused to reciprocate only by a predetermined distance by a not shown drive means. An air cylinder 98 is secured to the movable base 96, and drives an air tube 100 to reciprocate in horizontal directions (in axial directions of the tube) orthogonal to the movable base 96 moving direction, the air tube 100 being connected to a not shown pneumatic source.

The support body 90 is designed to be adsorbed to and held by the opening of the air tube 100 through a forward helping tool 101. The support body 90 includes: the bonding section having a curved surface corresponding to the machined surface (inner surface) of the lens material 66; and a support section that is supported by the rotary spindles 42, 46 of the outer surface roughing device 38 and the outer surface finishing device 40. For example, an adoptable support body 90 has a truncated conical bonding surface whose front surface is spherically convex and a flangelike support section that is projected from the base of the bonding section outward in perpendicular directions with respect to the axis of the support body 90. It may be noted that the support body 90 made of a material exhibiting excellent transmissivity for ultraviolet light such as acrylic resin is preferably used. Further, the forward helping tool 101 is designed to be assembled to the support body 90. For example, an adoptable forward helping tool 101 is bottomed, substantially cylindrical and has a plurality of slits on a circumferential wall section, the slits axially extending from the opening thereof so that the circumferential wall section can be deformed to expand. As a result of this construction, such forward helping tool 101 allows the bonding section of the support body 90 to be inserted from the opening thereof and firmly fixed to the circumferential wall section thereof.

Further, in the first moving end of the movable base 96 (the upper moving end shown by the phantom line in FIG. 6), a support body receiving container 104 is secured in the front of the opening of the air tube 100. The support body receiving container 104 not only receives the support body 90 that is guided from the support body containing section 102 (see FIG. 1) by a guide rail 105, but also supports the support body 90 so that the support body 90 can confront the opening of the air tube 100. The support body receiving container 104 has a face plate 109 that is rotated around a support shaft 108 by a rotary actuator 106, and holds the support body 90 guided from above in front of the face plate 109. Through the rotation of the face plate 109 around the support shaft 108, the thus held support body 90 is guided to the opening of the air tube 100. Further, the second air chute hose 25 is arranged on the side of the support body receiving container 104 so that the opening position thereof is defined. When the movable base 96 is positioned in the second moving end (the moving end shown by the solid line in FIG. 6), the opening of the air tube 100 is positioned so as to confront the opening of the second air chute hose 25.

Then, the air tube 100 is driven to project by the air cylinder 98 at the first moving end of the movable base 96 to thereby insert the support body 90 supported by the support body receiving container 104 into the forward helping tool 101 adsorbed to and held by the opening of the air tube 100 and to thereby allow the support body to be held together with the forward helping tool 101. The movable base 96 is thereafter moved to the second moving end, and the air tube 100 is driven to project by the air cylinder 98 to thereby allow the opening of the air tube 100 to face the opening of the second air cute hose 25. Then, compressed air is jetted out via the air tube 100. As a result of these operations, the forward helping tool 101 having the lens material 66 inserted thereinto can be fed into the second air chute hose 25 and forwarded therethrough.

Figure 8:
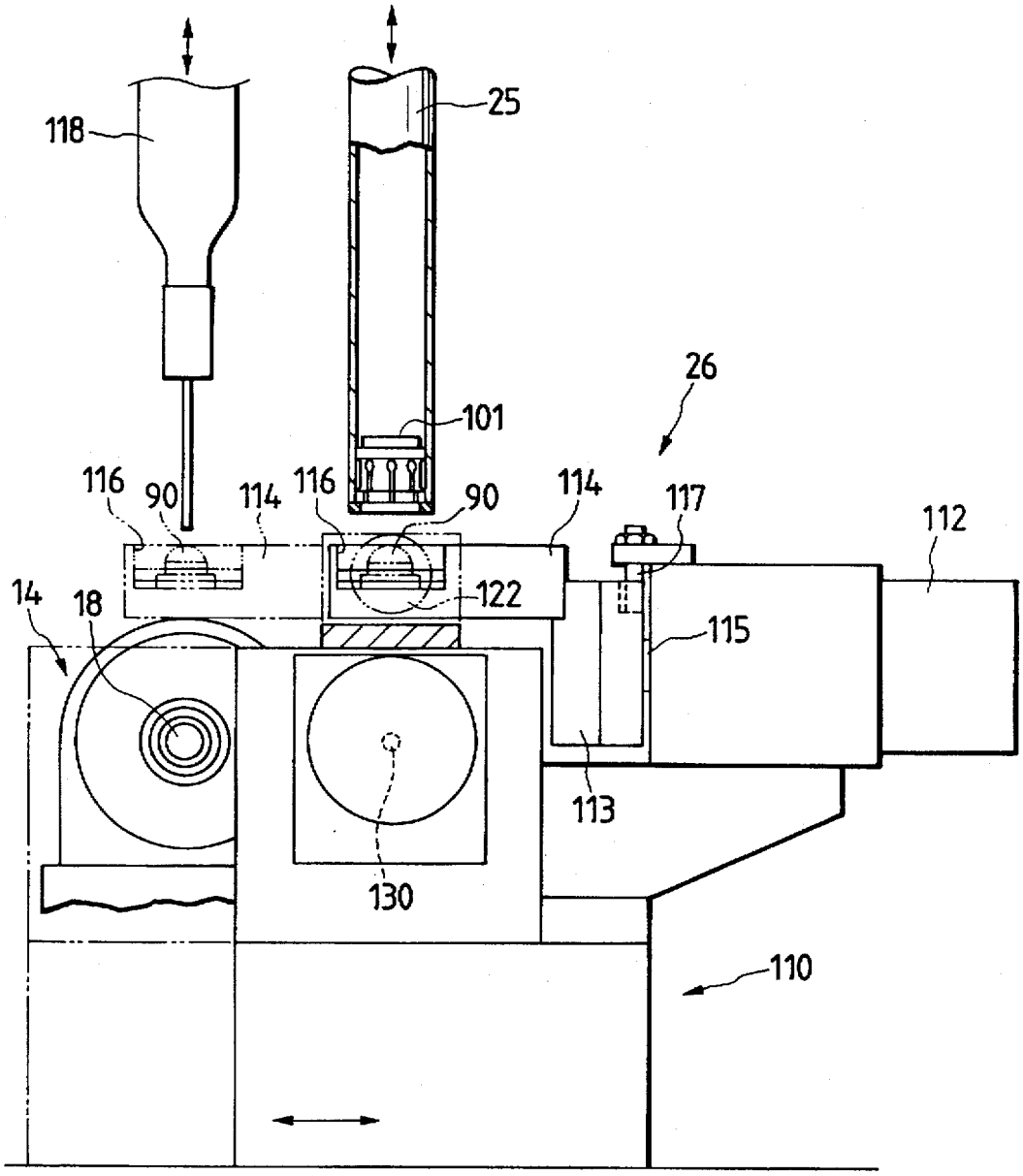
FIG. 8 is a front view schematically showing a construction of a support body supply device constituting the contact lens cutting apparatus shown in FIG. 1.
Figure 9:
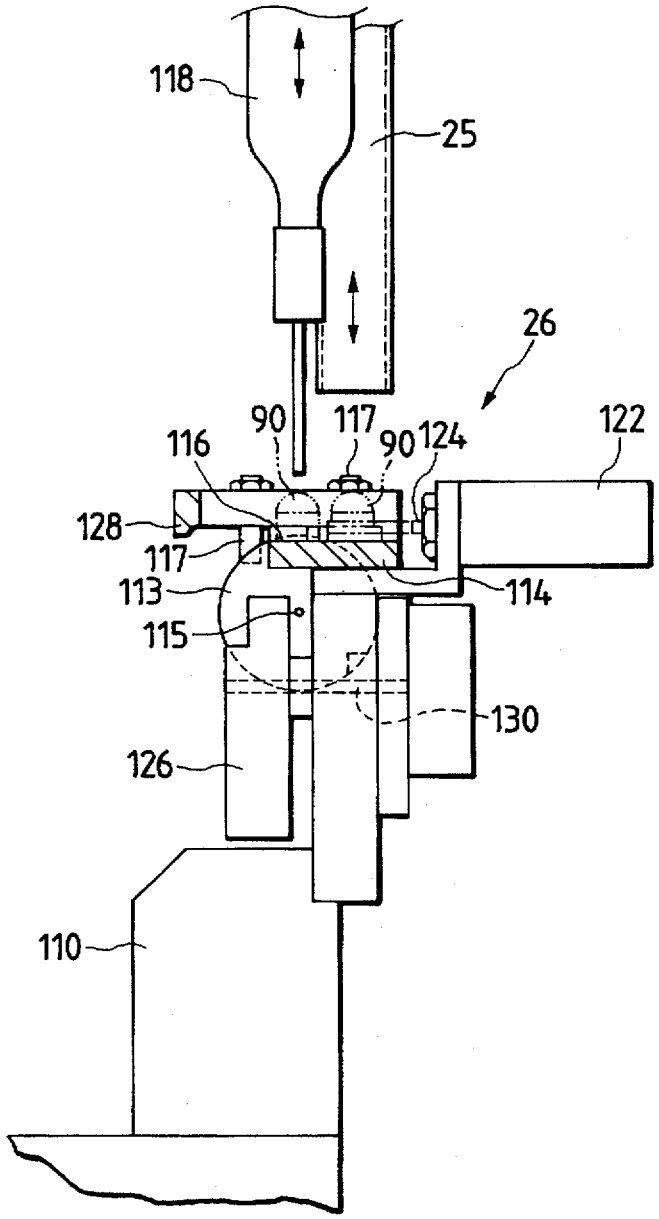
FIG. 9 is a side view schematically showing the support body supply device shown in FIG. 8.
Figure 10:
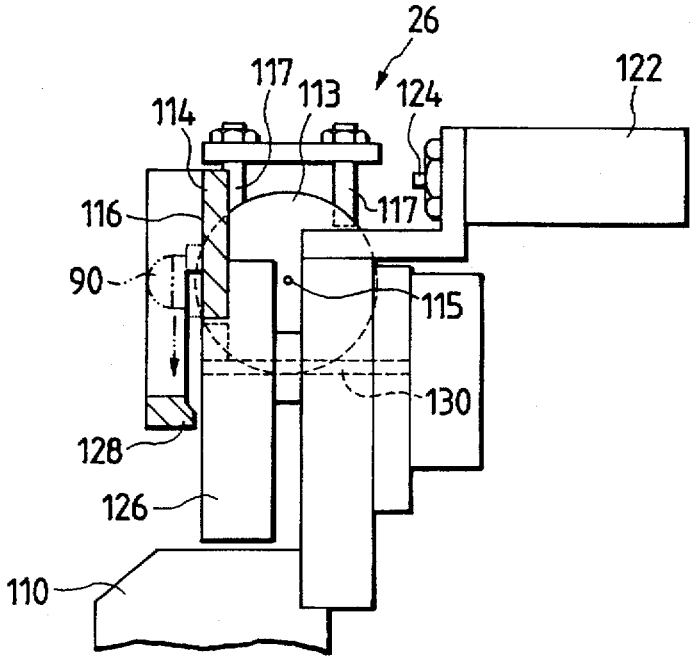
FIG. 10 is a diagram illustrative of an operation of the support body supply device shown in FIG. 1.

Further, FIGS. 8 to 10 show the support body supply device 26. The support body supply device 26 receives the support body 90 forwarded via the second air chute hose 25 by the aforementioned pneumatic forward section 92, and overlaps the curved surface of the support body 90 upon the machined surface of the lens material 66 chucked by the rotary spindle 18 of the inner surface machining device 14 and bonds the thus overlapped surfaces together after the ultraviolet curing adhesive has been dropped onto the curved surface of the support body 90 in the UV adhesive dropping process S6 and in the aligning process S6.

Figure 11:
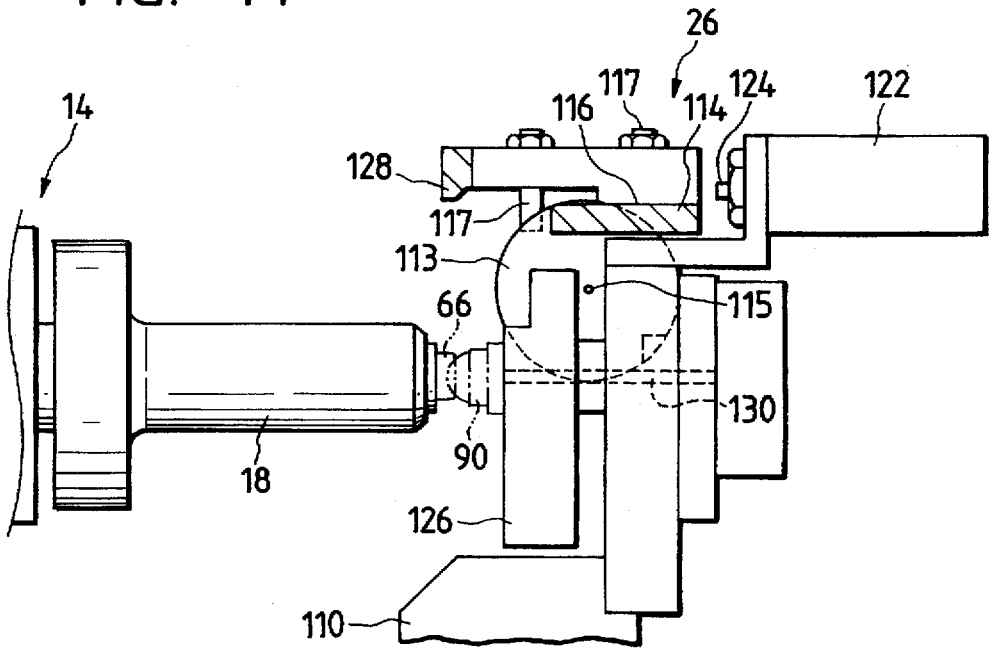
FIG. 11 is a diagram illustrative of an operation of the support body supply device shown in FIG. 1, such operation being different from the operation shown in FIG. 10.

The support body supply device 26 has a table 110. The table 110 is driven to reciprocate by a not shown drive mechanism in the space between the confronting surfaces of the rotary spindle 18 and the first cutter bench 20 of the inner surface machining device 14. The table 110 reciprocates in horizontal directions orthogonal to the confronting direction. A support board 114 is fixed, through a rotary plate 113, to a rotary shaft 115 of a drive motor 112 supported by the table 110. This support board 114 is designed to be reversibly rotated about the rotary shaft 115 by substantially 90° within a positioning range defined by stopper pins 117, 117, the rotary shaft extending in parallel with the table 110 moving directions. Further, this support board 114 has a recess 116. The recess 116 is opened vertically upward by the drive motor 112 at one of the rotating ends defined as a first support position (see FIGS. 8, 9, 11), whereas the recess 116 is opened horizontally at the other rotating end defined as a second support position.

By causing the recess 116 of the support board 114 to open upward at the table 110 withdrawing position as shown in FIG. 8, the opening of the recess 116 is positioned below the opening of the second air chute hose 25, so that the recess 116 receives the support body 90 forwarded by the second air chute hose 25 to thereby cause the curved surface of the support body to be supported vertically upward. It may be noted that an inwardly extending flange portion is arranged at the end of the opening of the second air chute hose 25. The flange portion has an inner diameter smaller than the outer diameter of the forward helping tool 101 and larger than the outer diameter of the support body 90. As a result, the flange portion retains the forward helping tool 101, which in turn allows the support body 90 to be moved away from the forward helping tool 101 and guided to the recess 116 of the support board 114 as a single body.

A UV adhesive dropping device 118 is arranged on the side of the second air chute hose 25. The UV adhesive dropping device 118 is above the recess 116 of the support board 114 at a position to which the table 110 has advanced. The UV adhesive dropping device 118 drops an appropriate amount of the UV curing adhesive onto the curved surface of the support body 90 held within the recess 116 of the support board 114. It may be noted that a piston rod 124 of a pin cylinder 122 secured to the table 110 is designed to be projected into the recess 116 of the support board 114 that is opened upward as shown in FIG. 9. That is, the support body 90 is correctly guided and set in the adhesive dropping position, at which adhesive dropping operation is performed by the UV adhesive dropping device 118, by the piston rod 124 of the pin cylinder 122 biasing the support body 90 guided and held by the recess 116 from the second air chute hose 25. Further, although not shown in the drawings, a pneumatically adsorbing means or the like is arranged in the support board 114, if necessary, in order to hold the support body 90 in a position defined by the pin cylinder 122.

By setting the support board 114 using the drive motor 112 to the second rotating end from the adhesive dropping position at which adhesive dropping operation is performed by the UV adhesive dropping device 118, the support body 90 is slid downward within the recess 116 of the support board 114 as shown in FIG. 10. As a result, the support body 90 is guided on a surface vertical to a holding plate 126 secured to the table 110. It may be noted that the support board 114 has a stopper 128 that positions on the holding plate 126 the support body 90 that has been slid downward within the recess 116. The holding plate 126 has a pneumatically adsorbing means that holds the support body 90 at a predetermined position on the vertical surface.

After the support body 90 has been held on the vertical surface of the holding plate 126 in this way, the support board 114 is driven reversely by the drive motor 112 to thereby be removed from the holding plate 126. The rotary spindle 18 of the inner surface machining device 14 with the lens material 66 chucked thereto is caused to advance thereafter, so that the machined surface of the lens material 66 is caused to overlap upon the curved surface of the support body 90 held by the holding plate 126. Under such condition, the force of the holding plate 126 for adsorbing the support body 90 is either eliminated or reduced to thereby allow the support body 90 to move on the vertical surface of the holding plate 126. Then, the rotary spindle 18 of the inner surface machining device 14 is driven at a low speed to cause the lens material 66 and the support body 90 to rotate relative to each other. As a result, the lens material 66 and the support body 90 are automatically aligned with each other by the concave surface and the curved surface that overlap one upon the other.

Further, the holding plate 126 has an optical fiber 130 passing therethrough. This optical fiber 130 guides light from the first UV irradiation device 28 (see FIG. 1) to the place where the support body 90 is adsorbed to and held by the vertical surface of the holding plate 126. When the light is irradiated from the back (on the side of the base) of the support body 90, the light is irradiated onto the bonded surface of the support body 90 and the lens material 66 by transmitting the support body 90. That is, the adhesive dropped onto the curved surface of the support body 90 is cured by this ultraviolet irradiation through the optical fiber 130, which allows the support body 90 and the lens material 66 to be bonded together temporarily.

The lens material 66 to which the support body 90 has been bonded temporarily in this way is moved away from the holding plate 126 together with the support body 90 by the rotary spindle 18 of the inner surface machining device 14 being caused to withdraw from the holding plate 126 after the temporary bonding operation has been performed. Then, as described above, the lens material 66 is removed from the inner surface machining device 14 by the loader/unloader 70 shown in FIG. 5 and forwarded to the transfer conveyor 34 via the third air chute hose 32.

According to the cutting method and cutting devices described in detail, the operation of aligning the lens material 66 with the support body 90 and the operation of bonding the lens material 66 to the support body 90 that have been performed manually in the conventional art can be performed automatically with the lens material 66 supported by the rotary spindle 18 of the inner surface machining device 14. Therefore, operating efficiency can be improved significantly, which in turn allows consistent aligning accuracy to be obtained.

Since the ultraviolet curing adhesive is used as an adhesive for bonding the lens material 66 to the support body 90 in this embodiment, the adhesive can be cured by irradiating ultraviolet rays whenever necessary. This means that even in the case where it takes much time in aligning the lens material 66 with the support body 90 or in a like case, not only consistent bond strength can be obtained, but also temporary bonding and regular bonding can be effected separately.

In this embodiment the operation of temporarily bonding the lens material 66 to the support body 90 is performed separately from the operation of regularly bonding the lens material 66 to the support body 90, and it is after the lens material 66 has been taken out of the inner surface machining device 14 that the operation of regularly bonding the lens material 66 to the support body 90 is performed in order to obtain the desired bond strength. Therefore, time in which the lens material 66 is left supported by the rotary spindle 18 of the inner surface machining device 14 for bonding can be curtailed, which in turn advantageously contributes to improving the machining cycle.

The embodiment of the invention has been described in detail. This embodiment is merely an example of the invention to the letter. The invention is not construed as being limited only to such embodiment.

While the ultraviolet light is irradiated onto the bonding surface by transmitting the support body 90 in the aforementioned embodiment, ultraviolet light may, e.g., be irradiated from sideways or the like without being caused to transmit the support body 90.

Further, the bonding of the lens material 66 to the support body 90 may be completed with the lens material 66 attached to the rotary spindle 18 of the inner surface machining device 14.

Still further, while the case where the cutting of the concave surface of the lens precedes the cutting of the convex surface of the lens has been described in the aforementioned embodiment, the invention is also applicable to a case where the cutting of the convex surface of the lens precedes the cutting of the concave surface of the lens on the contrary.

Further, in the case where a prism-ballasted lens, a toric lens, or the like is cut, the invention is applicable to the cutting of such lens by, e.g., overlapping the machined surface of such lens upon the curved surface of the support body while inclining the centerline of rotation of the support body rotated by the second machining device by a predetermined angle with respect to the centerline of rotation of the rotary spindle of the first machining device with the lens material attached thereto.

Further, while the first UV irradiating device and the second UV irradiating device are independent of each other in the aforementioned embodiment, the first UV irradiating device may of course be used also as the second UV irradiating device.

Further, the invention is applicable not only to the fabrication of hard contact lenses and soft contact lenses, but also to the fabrication of other types of ocular lenses including intraocular implants.

The invention can be embodied in modes with various alterations, modifications, and improvements added thereto based on the knowledge of those skilled in the art although not enumerated in this Specification. It goes without saying that any of such modes of embodiment are covered by the scope of the invention as long as such modes of embodiment do not depart from the essential part of the invention.

What is claimed is:

1. An ocular lens fabrication method comprising steps of:

in overlapping a machined lens surface of a lens material upon a curved surface of a support body to be attached to a rotary spindle of a second machining device and bonding the machined lens surface of the lens material to the curved surface of the support body using a predetermined adhesive after one lens surface of the lens material has been machined with the lens material being supported by a rotary spindle of a first machining device, the second machining device cutting other lens surface of the lens material, overlapping the curved surface of the support body upon the machined lens surface of the lens material through the predetermined adhesive with the lens material being supported by the rotary spindle of the first machining device; and the lens material is aligned with the support body by rotating the lens material and the support body relative to each other while rotating the rotary spindle of the first machining device with the support body being allowed to move in directions orthogonal to a rotary shaft of the rotary spindle of the first machining device.

2. An ocular lens fabrication method according to claim 1, wherein the lens material is temporarily bonded to the support body with the lens material being supported by the rotary spindle of the first machining device; and the lens material is regularly bonded to the support body after having been removed from the rotary spindle of the first machining device.

3. An ocular lens fabrication method according to claim 1 or 2, wherein an ultraviolet curing adhesive is used as the adhesive; and ultraviolet rays are irradiated onto the lens material and the support body after the lens material has been aligned with the support body.

4. An ocular lens fabrication apparatus comprising:

a first machining device for cutting one lens surface of a lens material with the lens material being supported by a rotary spindle;

a support body supply device for not only guiding a support body toward the front of the lens material supported by the rotary spindle of the first machining device, the support body being attached to a rotary spindle of a second machining device for cutting the other lens surface of the lens material, but also supporting the support body with the support body being allowed to move in directions orthogonal to a rotary shaft of the rotary spindle of the first machining device by overlapping the one machined lens surface of the lens material upon a curved surface of the support body;

an adhesive supply device for supplying a ultraviolet curing adhesive between the one surface of the lens material and the curved surface of the support body, the one lens surface and the curved surface having been overlapped one upon the other; and a first ultraviolet irradiation device for guiding and irradiating ultraviolet rays between the one lens surface of the lens material and the curved surface of the support body having been overlapped one upon the other through the ultraviolet curing adhesive.

5. An ocular lens fabrication apparatus according to claim 4, wherein the ultraviolet rays irradiated by the first ultraviolet irradiation device are guided between the one surface of the lens material and the curved surface of the support body having been overlapped one upon the other by transmitting the support body.

6. An ocular lens fabrication apparatus according to claim 4 or 5, wherein a second ultraviolet irradiation device is arranged, the second ultraviolet irradiation device guiding and irradiating ultraviolet rays onto a bonded surface of a bonded body along a transfer path of the bonded body toward the second machining device, the bonded body being formed of the lens material and the support body, the bonded body having been removed from the rotary spindle of the first machining device.

7. An ocular lens fabrication apparatus according to claims 4 or 5, wherein the rotary spindle of the first machining device is constructed of a horizontally extending rotary center shaft; and the support supply device has a support board being turned to a first support position of supporting the curved surface of the support body so as to face vertically upward and to a second support position for supporting the curved surface of the support body so as to face horizontally, the curved surface of the support body being guided to a ultraviolet curing adhesive dropping position by the adhesive supply device at the first support position of the support board, the support body being guided to such a position as to allow the curved surface of the support body to confront the one surface of the lens material supported by the rotary spindle of the first machining device at the second support position.

8. An ocular lens fabrication apparatus according to claim 6, wherein the rotary spindle of the first machining device is constructed of a horizontally extending rotary center shaft; and the support supply device has a support board being turned to a first support position of supporting the curved surface of the support body so as to face vertically upward and to a second support position for supporting the curved surface of the support body so as to face horizontally, the curved surface of the support body being guided to a ultraviolet curing adhesive dropping position by the adhesive supply device at the first support position of the support board, the support body being guided to such a position as to allow the curved surface of the support body to confront the one surface of the lens material supported by the rotary spindle of the first machining device at the second support position.

* * * * *